US007896718B2

(12) United States Patent
Jones

(10) Patent No.: US 7,896,718 B2
(45) Date of Patent: Mar. 1, 2011

(54) FIN OR KEEL WITH FLEXIBLE PORTION FOR SURFBOARDS, SAILBOARDS OR THE LIKE

(76) Inventor: Cameron Grant Jones, Auckland (NZ)

( * ) Notice: Subject to any disclaimer, the term of this patent is extended or adjusted under 35 U.S.C. 154(b) by 0 days.

(21) Appl. No.: 11/917,259

(22) PCT Filed: Jun. 7, 2006

(86) PCT No.: PCT/NZ2006/000140

§ 371 (c)(1),
(2), (4) Date: Dec. 12, 2007

(87) PCT Pub. No.: WO2006/135256

PCT Pub. Date: Dec. 21, 2006

(65) Prior Publication Data

US 2008/0261470 A1 Oct. 23, 2008

(30) Foreign Application Priority Data

Jun. 13, 2005 (NZ) ..... 540706

(51) Int. Cl.
*B63B 1/00* (2006.01)

(52) U.S. Cl. ..... 441/79

(58) Field of Classification Search ..... 441/79; 114/127–143, 67 A, 274

See application file for complete search history.

(56) References Cited

U.S. PATENT DOCUMENTS

| | | | | | |
|---|---|---|---|---|---|
| 3,680,511 | A | * | 8/1972 | English | 114/162 |
| 4,077,077 | A | * | 3/1978 | Harper | 441/79 |
| 4,515,101 | A | * | 5/1985 | Akerblom | 114/162 |
| 4,644,889 | A | * | 2/1987 | Krans | 114/40 |
| 4,733,496 | A | | 3/1988 | Wallner | |
| 4,811,674 | A | * | 3/1989 | Stewart | 441/79 |
| 5,951,347 | A | * | 9/1999 | Hudson et al. | 441/79 |

FOREIGN PATENT DOCUMENTS

| | | | |
|---|---|---|---|
| DE | 3248580 | | 7/1984 |
| DE | 3408532 | | 9/1985 |
| EP | 245571 | A1 * | 11/1987 |

* cited by examiner

*Primary Examiner* — Ed Swinehart
(74) *Attorney, Agent, or Firm* — Young & Thompson

(57) ABSTRACT

Keel or fin (1) for a watercraft such as a surfboard is conventional in shape but comprises major portion (2) fixed to the board by peg (10) and minor, flexible, trailing portion (3) fixed to major portion (2). Minor portion (3) has a more rigid leading edge (16) which slides dovetail fashion onto trailing edge (8, 9) of major portion (2) and is locked in place by grub screw (7). Minor portion (3) has core (11) of rubber allowing it to flex sideways under water pressure. Excessive movement of trailing edge (12) of minor portion (3) is prevented when edge (12) contacts stops (4) positioned on either side on the board. Minor portion (3) may be completely surrounded in an aperture in major portion (2) or may have apertures to which air is fed via ducting.

18 Claims, 24 Drawing Sheets

STANDARD FIN

FIN OR KEEL WITH FLEXIBLE PORTION FOR SURFBOARDS, SAILBOARDS OR THE LIKE

FIELD OF INVENTION

This invention relates to improvements to part of or parts associated with a waterborne craft, in particular but not exclusively to one or more of the fins associated with a surf or sail board, that are either mountable to or are integral with the board.

BACKGROUND ART KNOWN TO THE APPLICANT

The introduction of a keel or centreboard on a marine vessel such as a boat counteracted the problem of unwanted leeward motion of the vessel and also assisted in its stability. Other types of fin fitted to other types of waterborne craft tend to serve similar purposes but in addition, may also be targeted towards solving or counteracting other problems that the craft experiences in the water.

For example, the design of a surfboard is ultimately a compromise between speed and maneuverability as a surfer moves through the surf. Typically, large fins tend to provide greater control but at a cost of increased drag and as a consequence reducing the top speed of the board. Increasing competition and professionalism in the sport of surfing (be it windsurfing or traditional wave surfing) has led to a desire for improved equipment performance.

As such, the traditional long board with a fixed large "keel" fin located towards one end along the longitudinal axis of the board has to all intents and purposes, been replaced by a shorter surfboard and a fixed three fin configuration.

The same thing, albeit to a lesser extent has occurred for sail boards. In either case, in this contemporary configuration, the keel fin has become smaller with two 'mirror image', cambered lateral fins being located on either side of the board's longitudinal axis and near to the edge of the board.

Shaped like an aircraft wing in cross section with a high pressure substantially planar surface on one side and a low pressure curved surface on the other, these lateral or side fins once fitted to the board, point towards the longitudinal axis of the board and are substantially equidistant from the keel fin.

With such an arrangement, a surfer who has 'caught a wave' and is in the process of propelling the board through the water in a straight line, feels the effects of the physics of fluid mechanics which dictate inter alia that so called 'attached laminar fluid flow' around either side of each of the fins occurs following the Coanda effect during this linear motion.

During high turns rates however, the fins can eventually experience an interruption of this laminar flow as the fluid stream is no longer able to follow the fin's surface and turbulence begins to occur typically initially along the low pressure surface of a side fin. This turbulence and onset of the loss of the Coanda effect is shown in FIG. 1 which is a stylised view of the underside of a conventional three fin surfboard and water flow across one of the lateral fins.

Once turbulence occurs the benefit of the differential pressure on either side of a fin begins to be lost. In other words, control of the board as it cuts through the water begins to be lost.

It has been said amongst the surfing community that continued turning of the surfboard, especially at high turn rates leads to the start of a well known phenomenon called cavitation, that is the sudden formation and collapse of low-pressure bubbles in liquids by means of mechanical forces (for example those resulting from the rotation of a marine propeller).

This so-called cavitation can cause a surfer travelling at very high speed to experience a drastic 'spin out' as the attached water flow passing over the low pressure side of the fin 'detaches' leading to a total loss of control of the board and an otherwise ungainly entry into the water for the surfer.

These days, there is a move to remove the word "cavitation" from the vocabulary of surfers as the phenomenon that causes 'spin out' is probably not cavitation (as the speeds required are unlikely to occur even in the most extreme of surfing conditions) but more probably a phenomenon known as ventilation.

Ventilation occurs when a fin is out of the water momentarily (which often occurs during surfing and especially on turning) and a large a amount of surface air is violently 'sucked' down the low pressure side of the fin in substantially the direction of the longitudinal axis of the fin, interrupting attached water flow causing it to 'detach' and as a consequence, causing spin out to occur.

Attempts to overcome this problem of spin out caused through either cavitation or ventilation has centred around the design of the lateral fins. It has been found that introducing lateral fins that are able to pivot completely, allows sharper turns to be possible but at the cost of the forward drive of the board as any movement of the fins causes a reduction in speed.

The introduction of yet smaller lateral fins increases forward drive but decrease a surfer's ability to control a turn.

This problem of compromise has existed since the fin was introduced to a board.

OBJECT

It is an object of the present invention to provide means to enable an improved waterborne craft or indeed an improved waterborne craft, in particular but not exclusively a surf or sail board, that tends to alleviate this degree of compromise or at least provides the public with a useful choice and whilst the present invention is embodied in several different aspects, it will be apparent from this broad background review that each of these aspects are so linked as to form part of the same inventive concept.

STATEMENTS OF THE INVENTION

According to a first aspect of the present invention there is provided a keel, fin, or centreboard for use with a waterborne craft comprising a first portion operatively linked to a second portion wherein the first portion is adapted to move relative to the second portion and wherein the keel, fin, or centreboard is provided with a stop member to prevent unwanted movement of the first portion.

Each portion could be of substantially equal size or volume. Although the first portion could be a major portion of the keel, fin or centreboard relative to the second portion (the minor portion), preferably, the first portion is a minor portion and the second portion is a major portion of the keel, fin or centreboard.

With such an arrangement in mind, the first or the minor portion of the fin is likely to be the only part that moves and is restricted in its relative movement, the gains made in the degree of control associated with turning tend not to be at the total expense of lost forward drive of the board.

The movement of the first portion relative to the second portion may be a pivotal movement of the first portion with no flexing of the first portion at all or alternatively, the first portion may effectively pivot and flex or curl as it moves as a result of water pressure acting on it.

Preferably, movement of the first portion is in the form of a progressive flexing curl substantially about a leading edge of the first portion fixed point. As the thickness of the first portion decreases in a tapered uniform manner as it moves from its leading edge to its trailing edge, the degree of "flexing curled" movement will increase.

As a result of the nature of fins associated with boards and their means of attachment, the stop member could form part of the overall fin but be a separate from it. In other words the stop member need not be integral with the fin but could form part of it. As an example, the fin and stop member may each be glued onto the board separately and finished in a traditional manner.

Alternatively, the stop member may be integral with the fin and as such, could form part of the second portion or the first portion.

Preferably, the stop member forms part of the second portion, thus enabling the first portion to potentially sit, locked within the second portion to present a traditional fin to the water when unwanted movement of the first portion is desired.

There may be more than one stop member, for example one acting on one part of the first portion of the fin and one acting on another part of the first portion.

Preferably, there are two stop members each one acting on different parts of the first portion of the fin.

The surfing community are particularly astute when it comes to what they 'feel' is going to work and what is not and the introduction of a new type of fin that does not at first sight look like a traditional fin is not going to be accepted, thus although there are several ways available to a person skilled in the art to link the second and first portions of the fin together, one that results in a fin that at least looks like a traditional fin is preferable.

Thus, preferably, the second and first portions are provided with complementary engaging members to enable the portions to be operatively linked.

More preferably still, one of the complementary engaging members is provided with a guide member. This will assist the initial location of the other engaging member onto the one bearing the guide member.

Yet more preferably still, the guide member is located on the engaging member carried by the second portion.

Once the two portions are operatively linked, they may be disengaged through the action of water on the fin unless some form of locking member is used to lock the second and first portions together once they are engaged in an operatively linked manner. The locking member may be some form of snap fit arrangement involving complementary aspects of the second and first portions however, one of the traditional ways of locking a fin to a board is preferably through the use of complementary male and female locking members.

Therefore, preferably, the fin is provided with complementary male and female locking members to lock the first portion to the second portion.

By tradition, if friction fit or gluing is not used, to lock fins to boards, the usually preferred alternative has been through the use of a grub screw that passes through the fin and into a complementary female screw threaded portion in the board.

With traditional fins, that use this type of lock, the board and the fin are both provided with a female screw threaded aperture. It is envisioned that the same process could be used to lock the first and second portions of the fin to each other.

More preferably, therefore, the same type of locking member is located on both the second and first portions. Thus, for example, 'female' screw threads could be found on both the second and first portions.

The first and second fin portions may be made from the same type of material, most typically plastics material, natural rubber, carbon fibre, metal or possibly wood, however, they may be made from different materials or any appropriate selection or combination the materials mentioned herein.

Preferably, the first portion is formed from two types of plastics material. If one of the plastics materials has a lower glass transition temperature with respect to the other (to all intents and purposes, if one is 'rubbery' and one is 'hard' at their "in use" temperature), then depending on the arrangement of hard and rubbery plastics that make up the first portion, the ability of the first portion to flex may be enhanced.

More preferably still, at least the leading and/or trailing edge of the first portion is formed from 'hard' plastics material. This will have the advantage that less movement along the leading edge of the first portion is possible thus enabling straight gluing of the first portion to the second portion to occur with a reduced possibility of detachment through the effects of water striking the "join".

Secondly, having a relatively harder plastics trailing edge will tend to prevent the mid-section of the trailing edge of the first portion from flexing through the action of water pressure and possibly causing the first portion to thus 'ride over' the top of the stop member and negating its purpose almost entirely.

The trailing edge of the first portion could, in principle form the entire trailing edge of the fin once the fin has been formed. It could form only a percentage of the total trailing edge of the fin and in certain instances, there may be occasions where none of the trailing edge of the fin is formed from the first portion.

Preferably, the first portion sits wholly within the second portion once both portions are operatively linked to form the fin.

The fin could be a keel, however the fin is preferably a lateral fin.

The first portion could form part of the leading edge of the fin and/or the trailing edge of the fin. In fact, the trailing edge of the first portion could form part of the trailing edge of the fin when it is operatively connected to the second portion however this need not necessarily be the case. For example, the first portion could sit within an aperture of the second portion, the trailing edge of the second portion forming part of the wall of the aperture.

However, preferably, the trailing edge of the first portion forms part of the trailing edge of the fin, once it has been operatively connected to the second portion.

More preferably, the first portion only forms part of the trailing edge of the fin.

Preferably the waterborne craft may be selected from the group comprising a dinghy, yacht powerboat, sailboard and surfboard.

Preferably, the keel, fin or centreboard is provided with a stop member to prevent unwanted movement of the first portion and wherein the fin is also provided with apertured ducting to enable a fluid to enter the ducting and exit through one or more of the apertures and over a portion of one side of the fin.

It is envisioned that such an arrangement will disturb any turbulence caused during a turn of the board to the extent that a degree of the Coanda effect will be re-established although the fluid stream no longer 'attaches to' and thus follows the surface of the fin, it is believed that it will still tend to follow a path similar to the outline of the fin but at a distance from it. Thus the tendency for spin out to occur will, it is hoped tend to be reduced.

Preferably, the ducting is located internally to the fin thus enabling the fin to keep its traditional shape.

The or each exit aperture of the ducting may overlie the second or the first portion of the fin, however preferably, the or each exit aperture overlies the major portion of the fin. Such an arrangement will allow all of the first portion of the fin to move, relative to the second portion.

The fin could be a keel, however the fin is preferably a lateral fin.

According to a second aspect of the present invention there is provided a keel, fin, or centreboard for use with a waterborne craft, wherein the keel, fin or centreboard is also provided with apertured ducting to enable a fluid to enter the ducting and exit through one or more of the apertures and over a portion of one side of the keel, fin or centreboard.

The fin could be a keel, however the fin is preferably a lateral fin.

The fluid may be a liquid supplied in a container that is mountable to the board, the liquid having properties that may help to re-establish the Coanda effect or alter the degree of surface tension that exists between the water and the fin.

The liquid could either reduce or increase the surface tension adjacent the fin surface.

However, preferably the fluid is air.

This air is 'sucked' down the ducting and expelled across the low pressure side of the fin in a controlled or otherwise metered fashion and in a direction substantially transverse to the longitudinal axis of the fin.

It is believed by the inventor that either or both of these effects serve to re-establish the Coanda effect and/or reduce the effect of turbulence which will, in turn, tend to reduce the incidents of spin out.

The nature of the surface of the fin may be substantially hydrophobic or substantially hydrophilic, in the alternative, one side of the fin may possess a hydrophobic surface whilst the other may be hydrophilic.

The invention includes within its scope a waterborne craft incorporating a keel fin or centre board as specified herein.

BRIEF DESCRIPTION OF THE DRAWINGS

Preferred embodiments of the present invention will now be more particularly described by way of example only with reference to the accompanying sheets of drawings in which.

DESCRIPTION OF THE PREFERRED EMBODIMENTS

Figure 1:
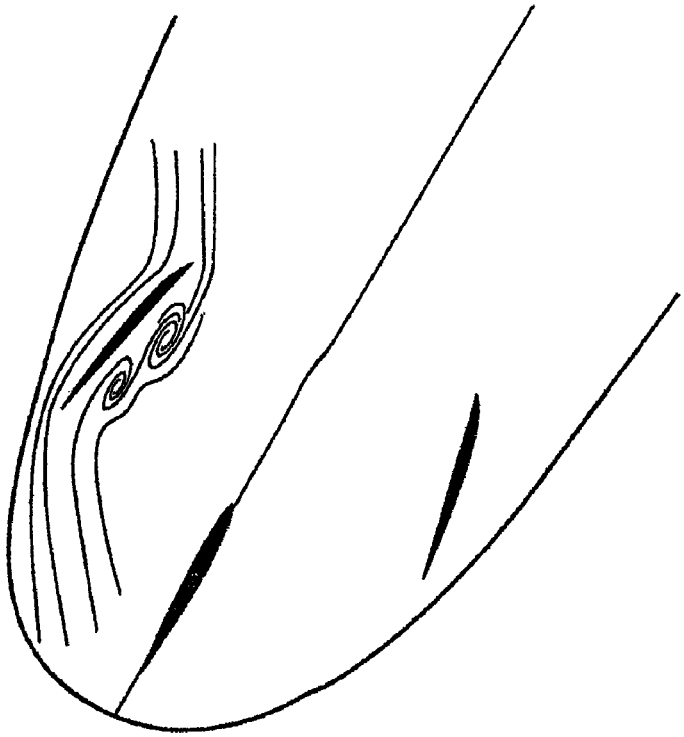
FIG. 1 illustrates an underside view of three surfboards showing their fin arrangement and a stylised view of water flow about each leading lateral fin, one of the boards being a prior art board and the two others being differing embodiments of the present invention.
Figure 2:
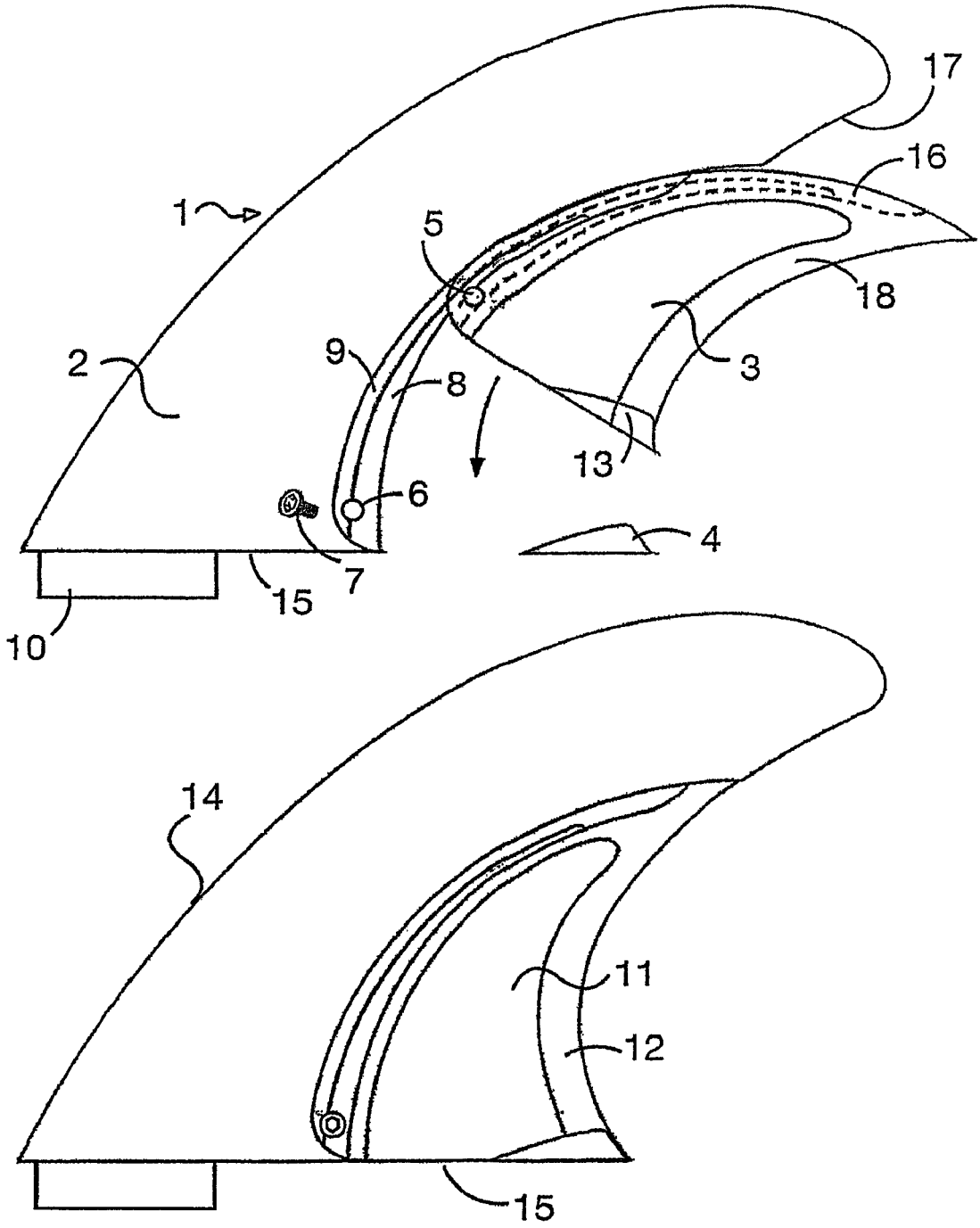
FIG. 2 illustrates a side view of one embodiment of the present invention showing a lateral in comprising a second portion being fitted with a flexible first portion, that is flexible in one direction only.

FIG. 2, shows a polymeric integral curved lateral fin formed from polypropylene material and natural rubber and is generally referenced (1). The fin (1) comprises a major portion (2) a minor portion (3) and a bevelled stop member (4).

The fin (1) is also provided with a flat base (15) and an integral columnar peg (10) located towards a convex leading edge (14) of the fin (1) which projects orthogonally from the base (15). The face of the fin (1) that is convex, whilst the opposing face is substantially planar.

Opposite the leading edge (14) is a somewhat similarly curved trailing edge (8, 9), which at its apex forms the base of another trailing edge of a nature of curvature (17) that is different to that of the trailing edge (8, 9).

The trailing edge (8, 9) of the major portion (2) is provided with a "dovetail" shaped projection (8) that extends from the base (15) of the major portion (2) along approximately 80% of the central length of the trailing edge (8, 9) of the major portion (2) and the projection (8) uniformally decreases in size as it extends linearly along from the base (15) along the length of the trailing edge (8, 9). The projection (8) does not project centrally from the trailing edge (8, 9) but is offset towards the flat side of the major portion (3).

A threaded well (6) that is located towards the base (15) extends at an angle into both a portion of the projection (8) and its associated corresponding recess or non projecting portion (9) of the trailing edge (8, 9).

The minor portion (3) is also provided with a leading edge (16) and a trailing edge (18). The nature of the curvature of the trailing edge (18) is similar to the nature of the curvature of trailing edge (17).

The leading edge (16) of the minor portion (3) of the fin (1) is provided with a complementary or female "dovetail" to that of the major portion (2) and is also provided with a similarly threaded aperture (5) to that of the well (6) and the aperture (5) is also located towards the base (15).

Similarly, the base (15) of the minor portion (3) is also provided with a complementary bevel (13) of similar shape and dimensions to that of the stop member (4).

The minor portion (3) is provided with a shaped core of natural rubber (11) that is integral with a peripheral high molecular weight polypropylene material (12) that extends from the base (15)/start of the leading edge (16) and surrounds the core (11) of the minor portion (3) of the fin (1) in a non-uniform manner, terminating at the base (15)/start of the trailing edge (18) of the minor portion (3).

In use, the base (15) of the major portion (2) will be provided with a layer of glue as too will the peg (10). Then the peg (10) will be pushed into a complementary well or aperture located in a lateral fin position in a surf or sail board (not illustrated) until the base (15) contacts the underside surface of the board.

Following this, the female "dovetail" of the minor portion (3) will be mated with the male "dovetail" of the major portion (2) through a sliding action operatively linking the two portions (2, 3) together.

These two dovetails will act as a 'pivot point', about which the minor portion (3) will flex in a curved manner when water pressure acts upon it in a particular direction. The pivot point itself will not move, it is merely that point about which the rest of the minor portion (3) will begin to move. The uniform tapering of the thickness of the minor portion (3) will mean that for the same pressure of water, a greater degree of flexing of the minor portion (3) will occur.

The base (15) of the stop member (4) will then be glued onto the board such that its bevelled surface contacts the complementary bevelled surface (13) of the minor portion (3).

A grub screw (7) provided with a complementary thread to that of the aperture (5) and well (6) is screwed into both aperture (5) and well (6) locking the major portion (2) to the minor portion (3) to form the fin (1).

Once connected in this way, all of the contacting surfaces of the fin (1) are substantially flush with each other leading to a fin whose overall shape in side profile is similar to that of a dolphin or otherwise conventional fin available to surfers.

The fin (1) is then finished off using conventional fin to board finishing techniques. If fin (1) is a lateral fin for a surf board, a similar "mirror image" fin of fin (1) will be produced for the other lateral fin.

The minor portion (3) is able to progressively flex away from the curved surface (as its thickness diminishes) and towards the opposing flat surface but is prevented from doing so in the opposite direction by the stop member (4).

The arrangement of such 'hard' (12) and 'soft' (11) material in the minor portion (3) tends to prevent the mid-section of the trailing edge (18) of the minor portion (3) from flexing through the action of water pressure and possibly causing the minor portion (3) to thus 'ride over' the top of the stop member (4) and flex in a an unwanted direction.

In the water, a surfer using such a pair of opposing lateral fins fitted to their board, as he/she performs a turn will cause one of the minor portions (3) of one of the lateral fins (1) to flex in the direction indicated above. Such a flexing tends to affect the turbulence generated in a turn in such a way as to assist in the prevention of the phenomenon known as spin out.

Figure 3:
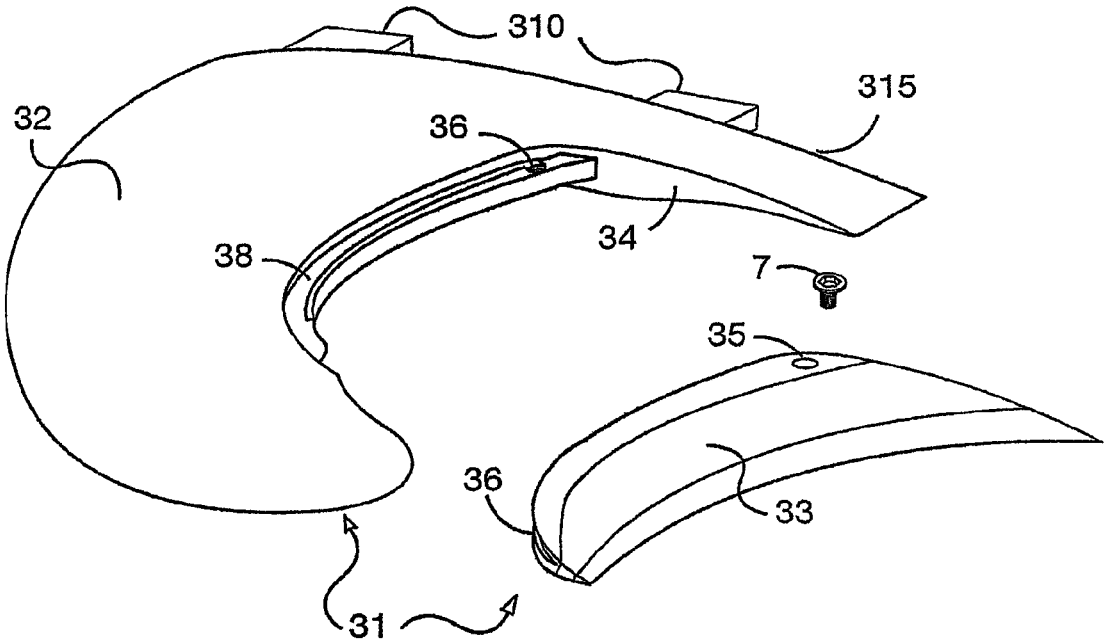
FIG. 3 illustrates an isometric exploded view of a lateral fin covering a second embodiment of the present invention.

Turning now to FIG. 3, this shows another embodiment of the present invention where the stop member (34) is integral with the major portion (32) of the integral lateral fin generally referenced (31) and where the stop member (34) bevel extends across substantially the entire length of the internal base face of the major portion (32).

In this particular embodiment, there are a pair of spaced apart pegs (310) located on the exterior base (315) of the major portion (32) adapted to mate with corresponding wells located in the board (not illustrated). The leading edge (33) of the minor portion (33) of the fin (31) operatively connects to the major portion (32) via the dovetail (38) in a similar manner to that described for the previous embodiment.

The grub screw (7) again locks both of the portions (32, 33) together as it passes through the aperture (35) and into the well (36), the latter in this particular embodiment being fully located within the dovetail (38) and the head of the screw (7) being substantially flush with the face of the curved surface of the fin (31), once screwed into place.

Figure 4:
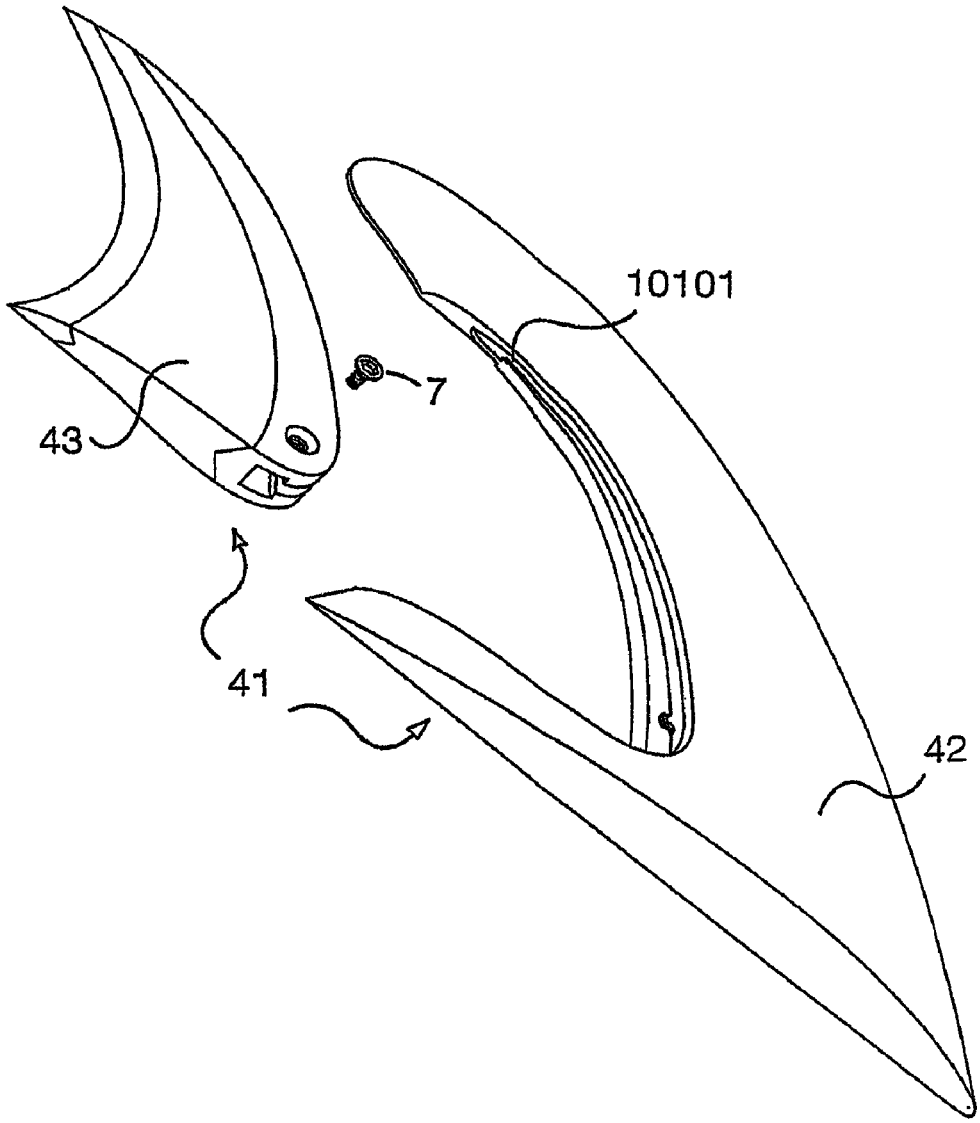
FIG. 4 illustrates an isometric exploded view of a lateral fin covering a third embodiment of the present invention.

Turning now to FIG. 4, this shows a lateral fin generally referenced (41). The view shown for the first time clearly shows what is present in each of the fins described herein, the substantially flat surface of one side of the fin (41) and the curved opposing surface.

Furthermore, in this particular embodiment, there is no peg and the major portion of the fin (42) is first glued onto the relevant board (not illustrated) and finished in the conventional manner. Instead of a dovetail, a "boxtail" is provided for linking both portions (41, 43). This embodiment also clearly shows a guide member (10101) located at the apex of the complementary engaging member of the major portion (42).

Figure 5:
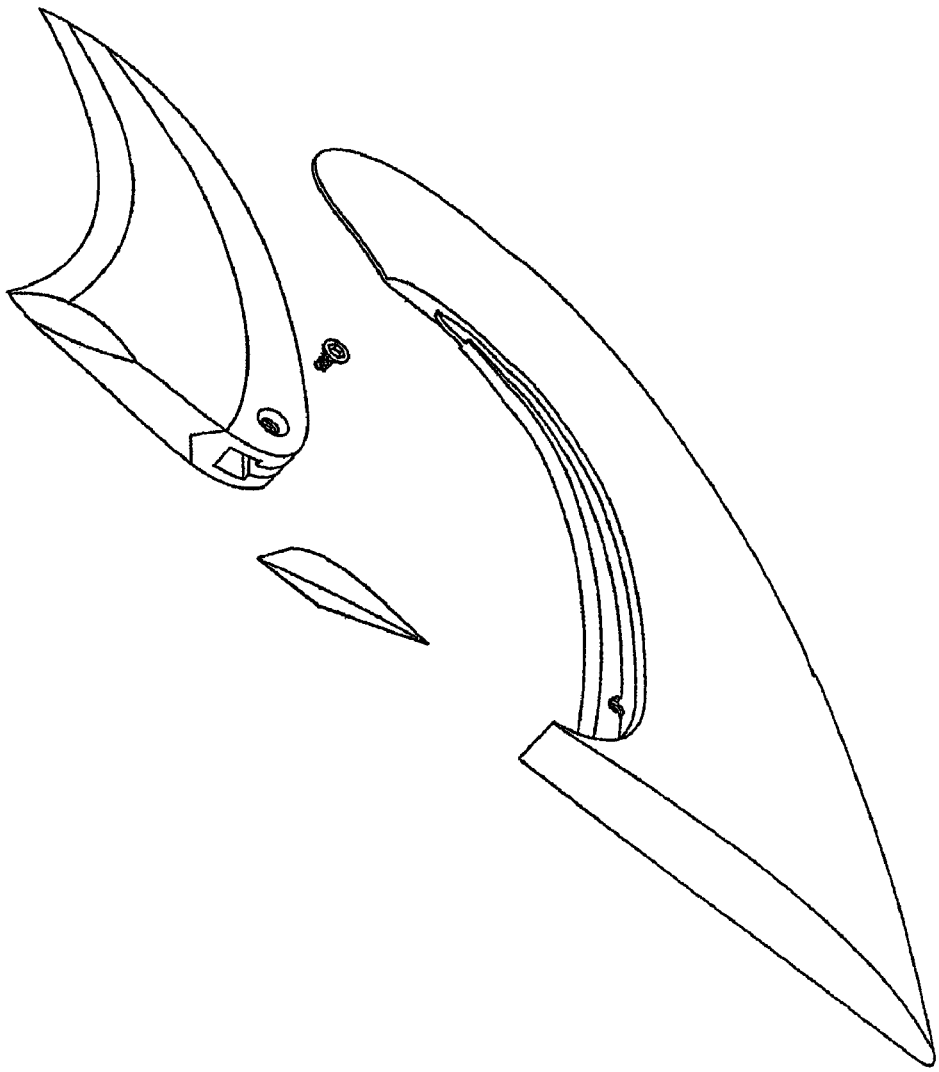
FIG. 5 illustrates an isometric exploded view of a lateral fin covering a fourth embodiment of the present invention.

FIG. 5 shows another variant somewhat akin to the first embodiment but without a peg and having a boxtail instead of a dovetail.

Figure 6:
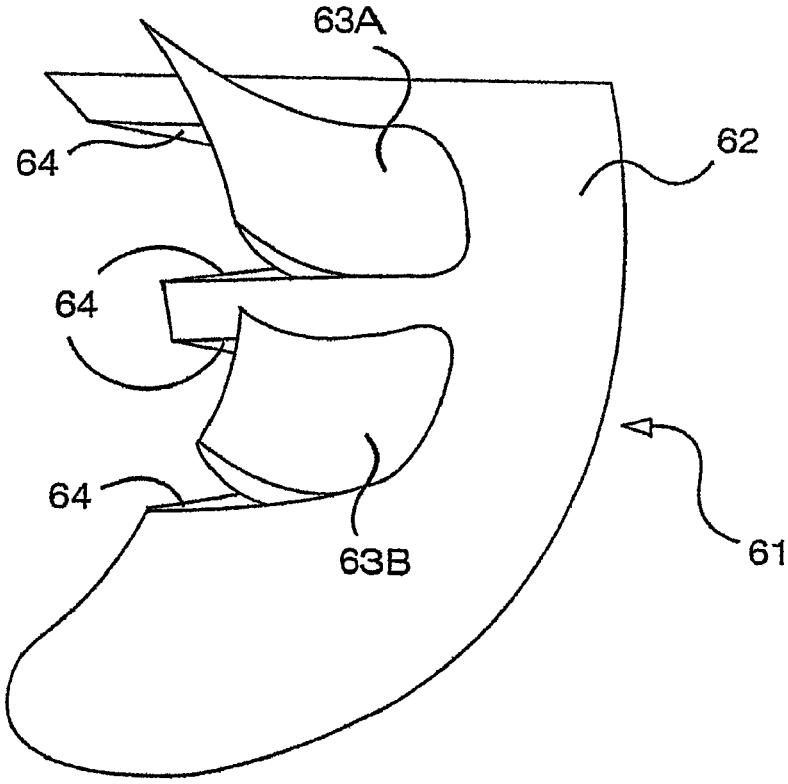
FIG. 6 illustrates an isometric view of a lateral fin in a flexed position covering a fifth embodiment of the present invention.

FIG. 6 shows another variant and is generally referenced (61). In this particular embodiment, there are two minor portions (63A & 63B) each operatively linked to the major portion (61) in a manner as previously described with notional variations obvious to a person skilled in the art, given the fact that the nature of the curvature required for the operative connection of the portions (62, 63A, 63B) is somewhat different.

This embodiment also shows the minor portions of the fin (61) in a flexed position revealing an instance of a stop member (64) extending along both a respective top and bottom edge of (in this case) a portion of the major portion (62).

Figure 7:
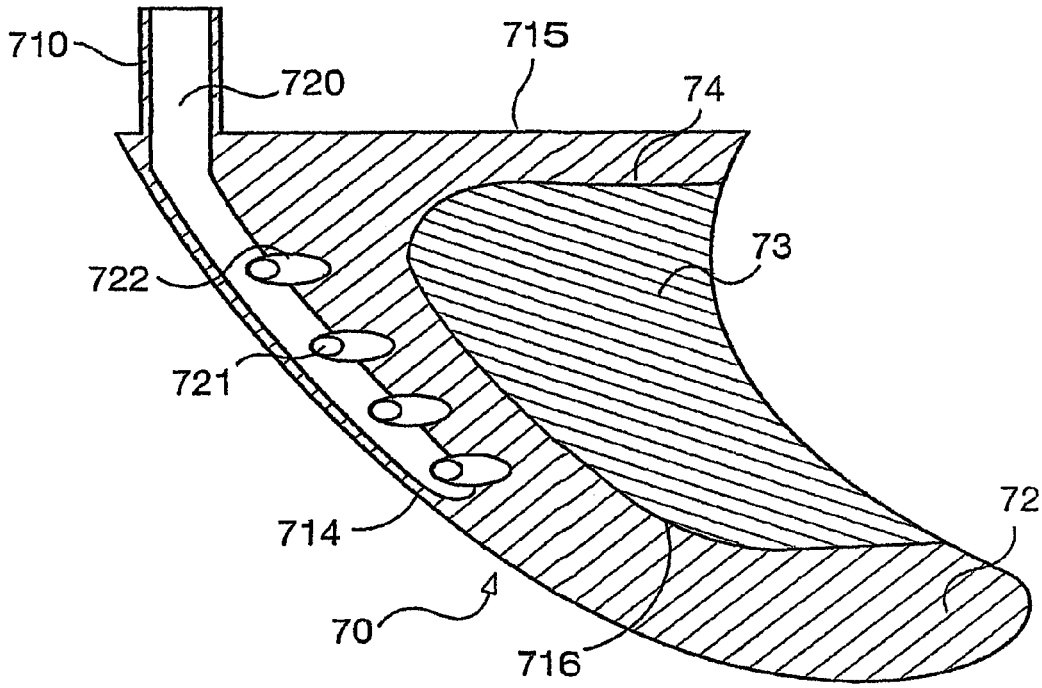
FIG. 7 illustrates a cross sectional view of a lateral fin covering a sixth embodiment of the present invention.

Turning now to FIG. 7, this shows another embodiment of the present invention and shows a lateral fin in cross section that is generally referenced (70).

The fin (70) is similar in many regards to the others described herein in so far as it comprises a major portion (72) with an integral stop member (74) and a minor portion (73) operatively linked together via a pair of complementary dovetails and an integral peg (710) located on the planar base (715) towards the leading edge of the major portion (712).

However, in this particular embodiment, the peg (710) is hollow and forms part of a conduit (720) of substantially uniform cross section that extends into the body of the major portion (72) following the curve of the leading edge (714) and terminating just below the top of the minor portion (73).

Equally spaced along the trailing side of the conduit (720) are four substantially circular apertures (721) that between them span substantially the length of the minor portion (73).

Each aperture (721) opens out onto the flat face of the fin (70) and in each case, the aperture (721) is located at one end of a recessed ellipse (722), the diameter of the aperture (721) being concentric with the longitudinal axis of the ellipse (721) of which it forms a part, the said longitudinal axis being substantially parallel with the base (715). Each ellipse (722) is of a similar size and shape.

The non aperture containing end of the ellipse (722) extends across the face of the fin (70) but terminates well before the leading edge (716) of the minor portion (73).

Figure 8:
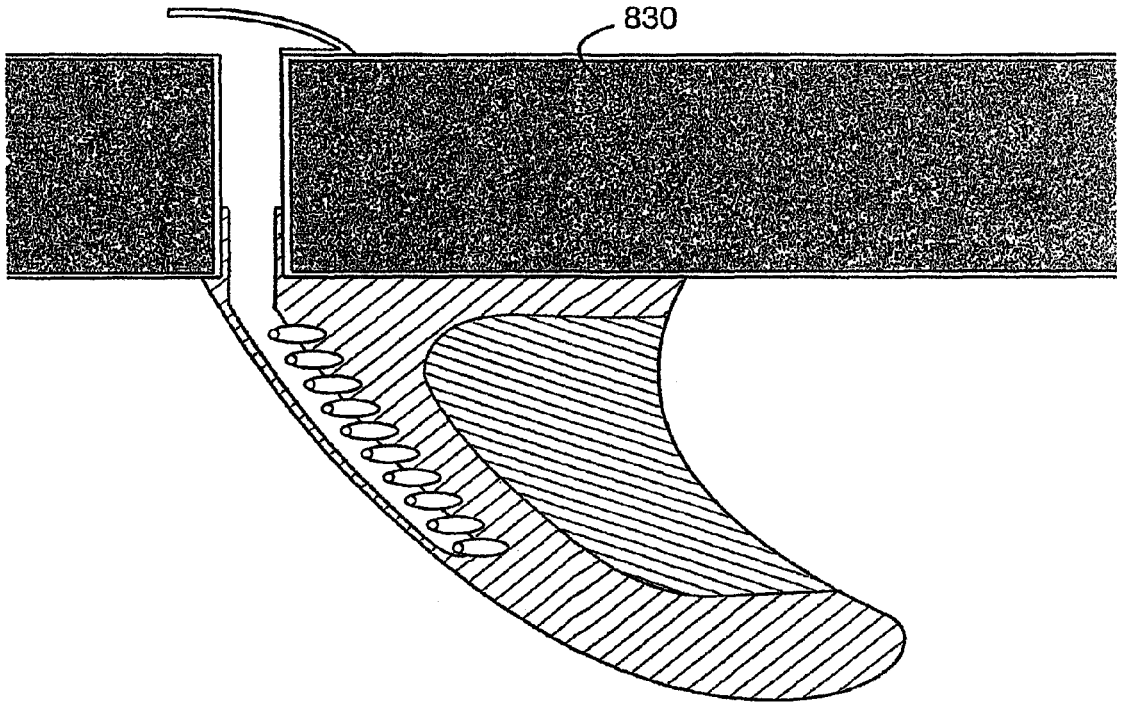
FIG. 8 illustrates a cross sectional view of the fin shown in FIG. 7 fitted to an underside of a surfboard.

FIG. 8 shows FIG. 7 mounted to the underside of a sail board (830), again all in cross section. As can be seen from the figure, the peg (710) is so sized and shaped as to extend part the way through the thickness of the board (830), the top surface of the board (830) in its normal attitude of operation being fitted with a curved non resilient cap that overlies the aperture in the board (830) trough which the peg (710) enters.

In this way, if a surfer treads onto the cap, the outside air from the top surface of the board (830) is not prevented from entering the conduit (720).

In use, as a surfer propels the board (830) fitted with the fin (70) through water, fluid, mainly in the form of air, is sucked into the conduit (720) and is expelled as a stream of air bubbles in a controlled and metered manner through the apertures (721) and across the flat face of the fin (70) in a direction that initially is substantially parallel with the base (715).

It is believed that this stream of air bubbles disrupts the turbulence generated across this face during turns and helps to re-establish the Coanda effect, although the water that would normally be "sticking" to the fin (70), will not be, however, its path of travel, it is believed will be closer to it thus reducing the instances of ventilation and spin out.

Figure 9:
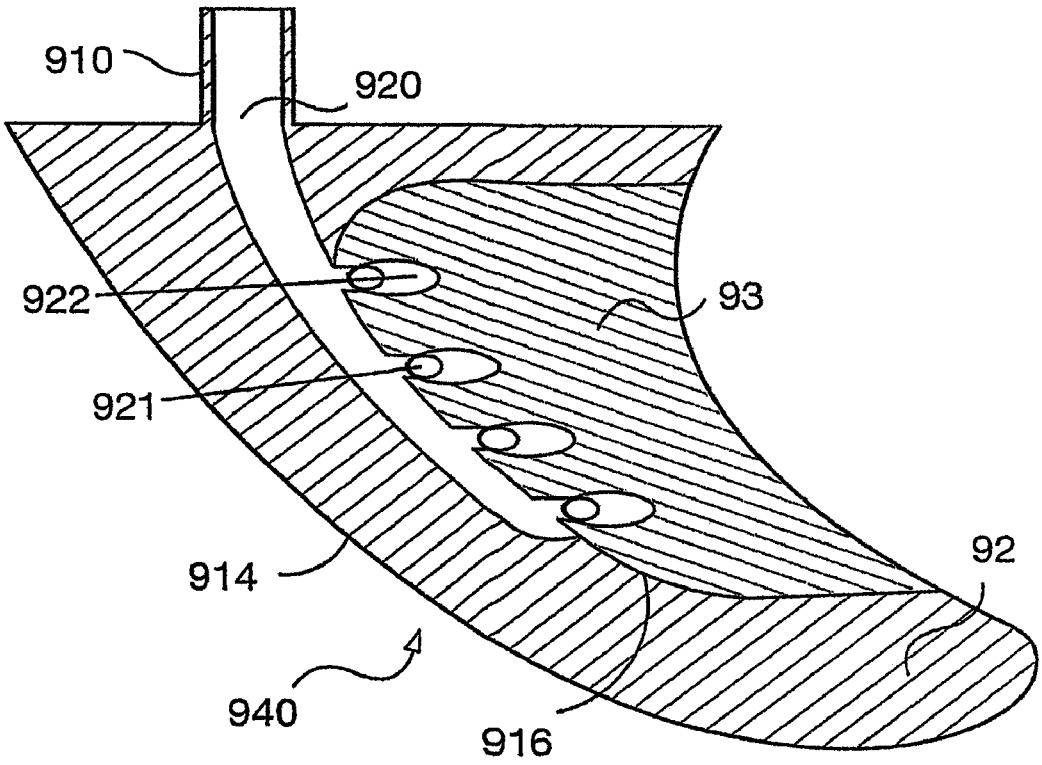
FIG. 9 illustrates a cross sectional view of a lateral fin covering a seventh embodiment of the present invention.

FIG. 9 shows a variant of FIG. 7 and in this embodiment, the location of the peg (910), conduit (920), apertures (921) and ellipses (922) have simply taken a side ways shift away from the leading edge (914) of the major portion (92) to the extent that the apertures (921) and ellipses (922) are now located slightly rearward of the leading edge (916) of and now form part of the flat face of the minor portion (93).

The trailing side of the conduit (920) is provided with minor branches (940) that extend through the male dovetail of major portion (92) and terminate in four apertures each of which overlie respective apertures (921) once the portions (92, 93) have been operatively connected.

The only difference in operation of this particular embodiment to that of the previously described one is that metered stream of air bubbles will only pass over the minor portion (93).

Figure 10:
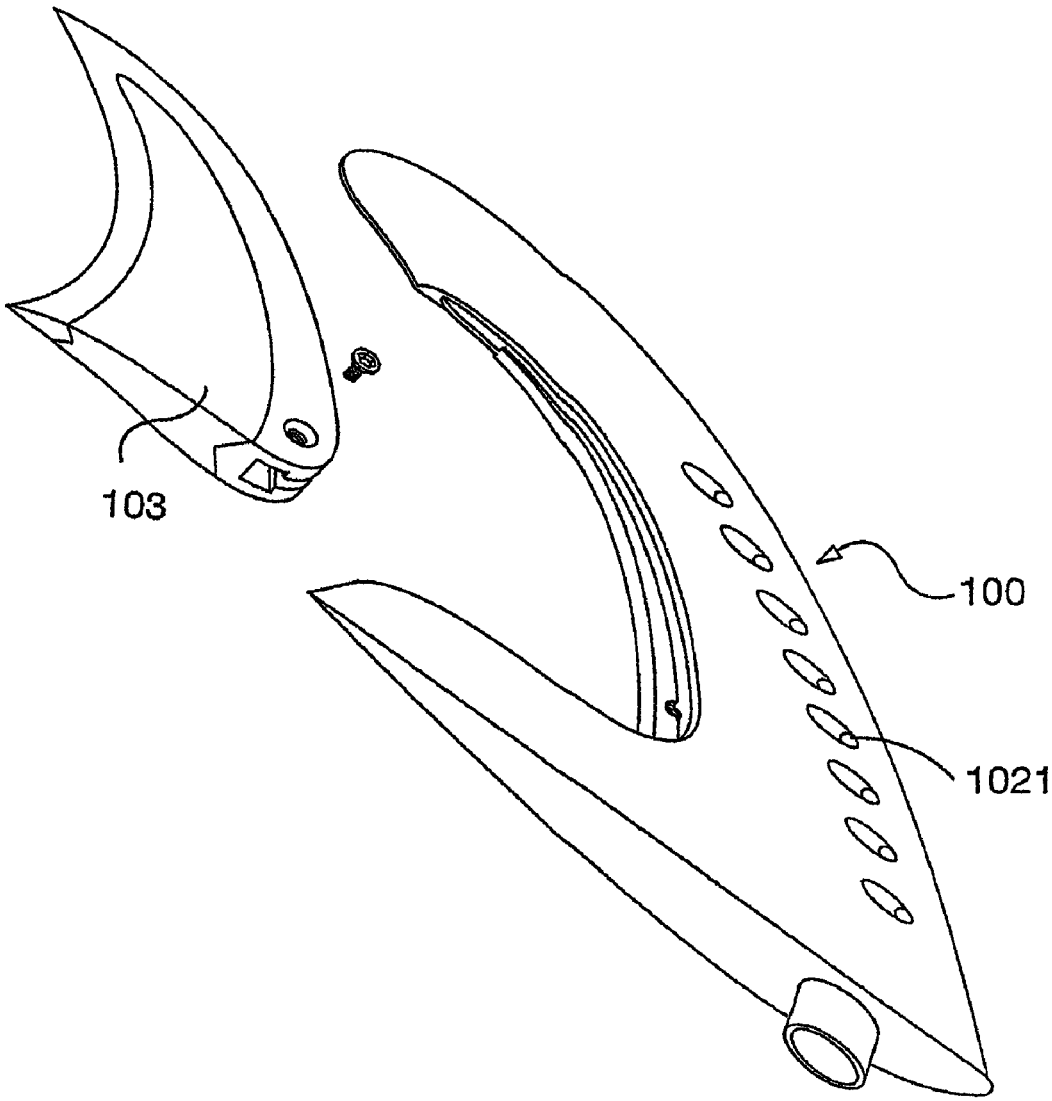
FIG. 10 illustrates an isometric exploded view of a lateral fin covering an eighth embodiment of the present invention.

Turning now to FIG. 10 this shows a lateral fin generally referenced (100) and simply shows a further variant of FIG. 7 with eight apertures (1021) that span the entire length of the minor portion (103).

Figure 11:
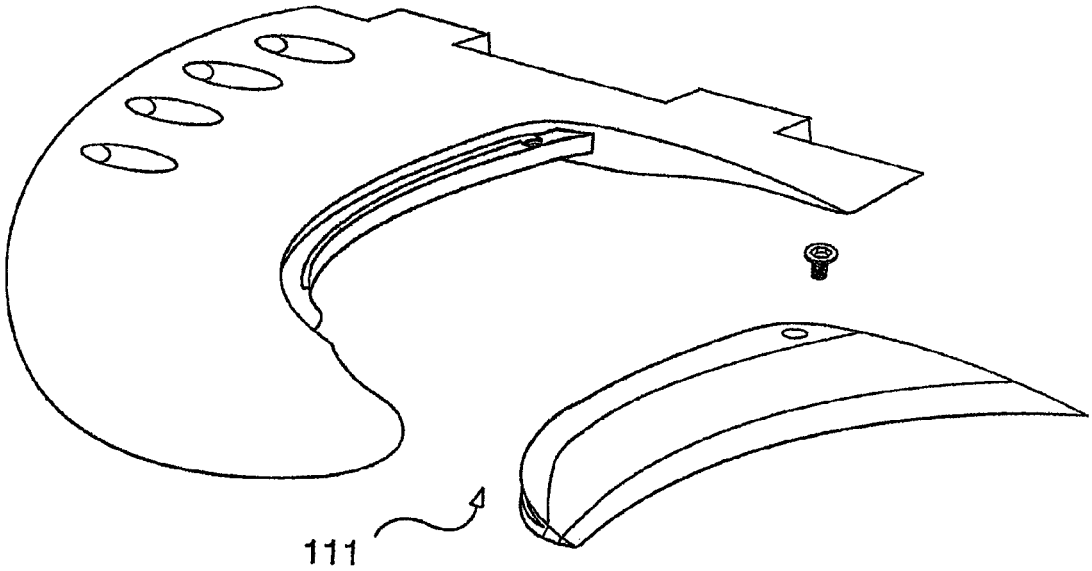
FIG. 11 illustrates an isometric exploded view of a lateral fin covering a ninth embodiment of the present invention.

FIG. 11 shows a lateral fin generally referenced (111) effectively shows the embodiment previously described in FIG. 3 except in this particular embodiment pegs (310) are missing and apertures as described in FIG. 7 are incorporated. In this particular embodiment, the aperture of the board would have to overlie at least partially, the conduit of the fin in this particular embodiment as the fin has no peg to speak of.

Figure 12:
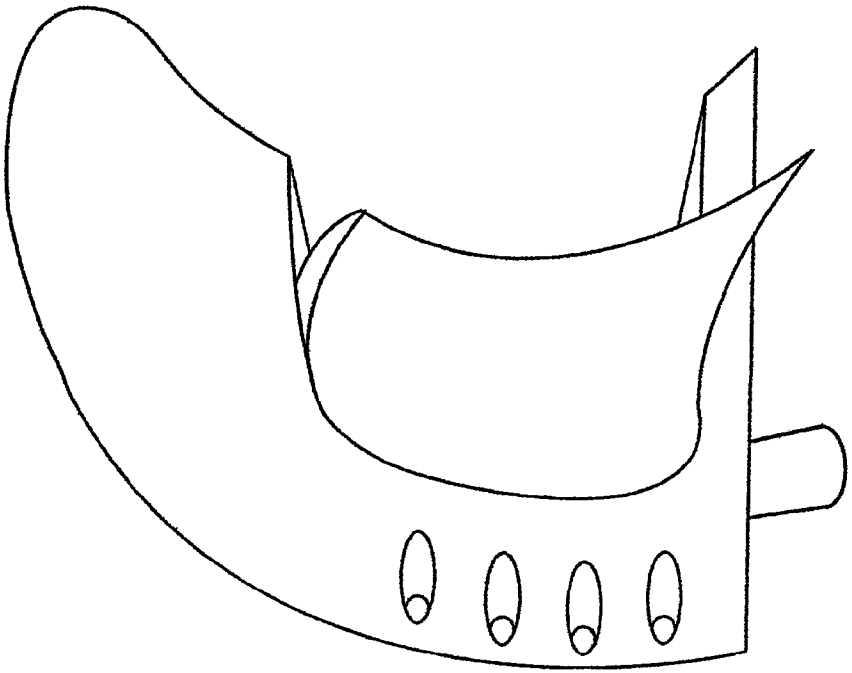
FIG. 12 illustrates an isometric view of a lateral fin in a flexed position covering a tenth embodiment of the present invention.

FIG. 12 shows an embodiment incorporating apertures located on the major portion and showing the minor portion flexing.

Figure 13:
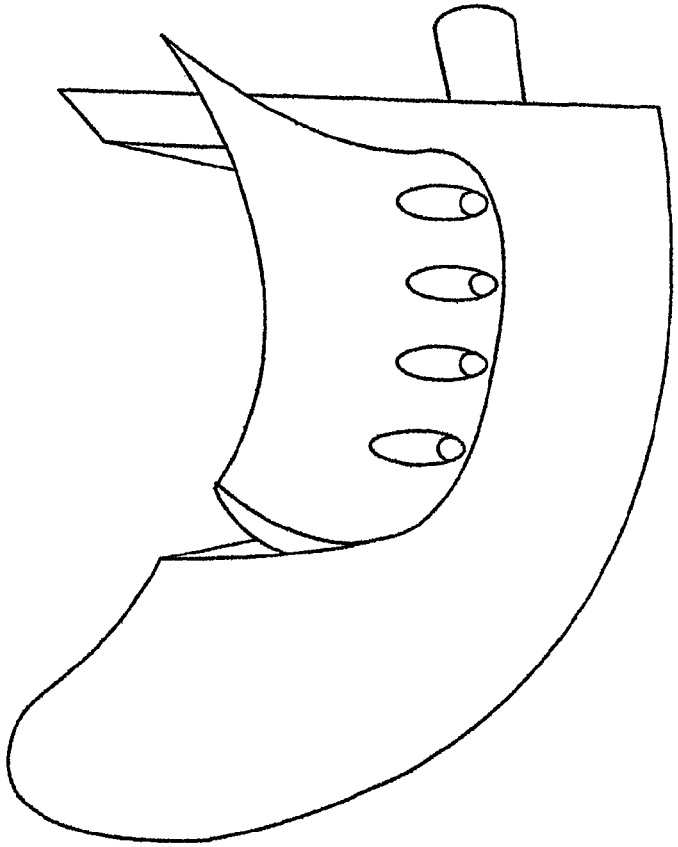
FIG. 13 illustrates an isometric view of a lateral fin in a flexed position covering an eleventh embodiment of the present invention.

FIG. 13 shows an embodiment incorporating apertures located on the minor portion and showing the minor portion flexing.

Figure 14:
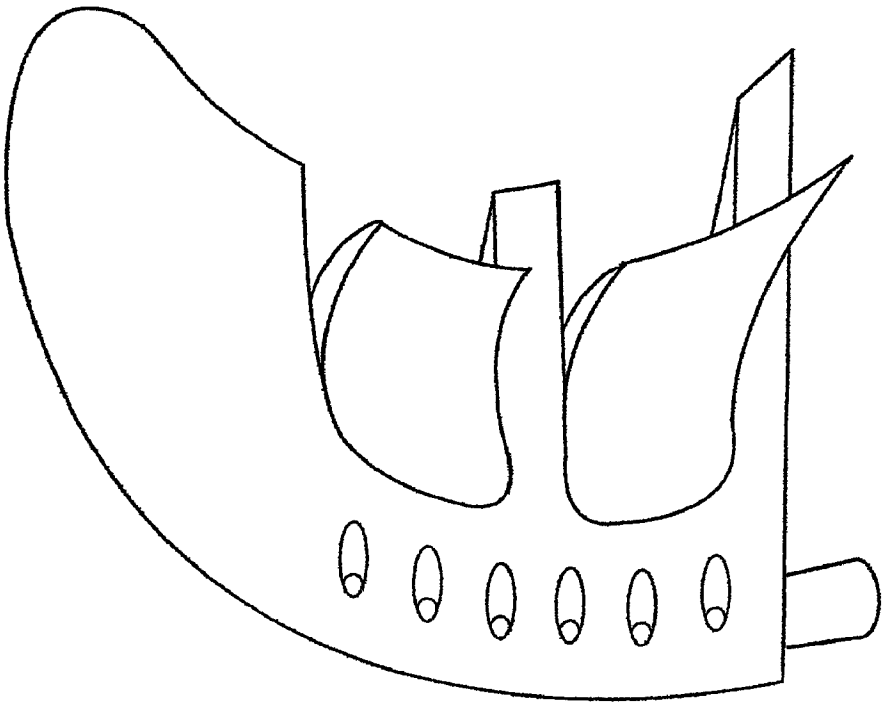
FIG. 14 illustrates an isometric view of a lateral fin in a flexed position covering a twelfth embodiment of the present invention.

FIG. 14 shows a variant of the embodiment described in FIG. 6 incorporating apertures on the major portion and showing both minor portions flexing.

Figure 15:
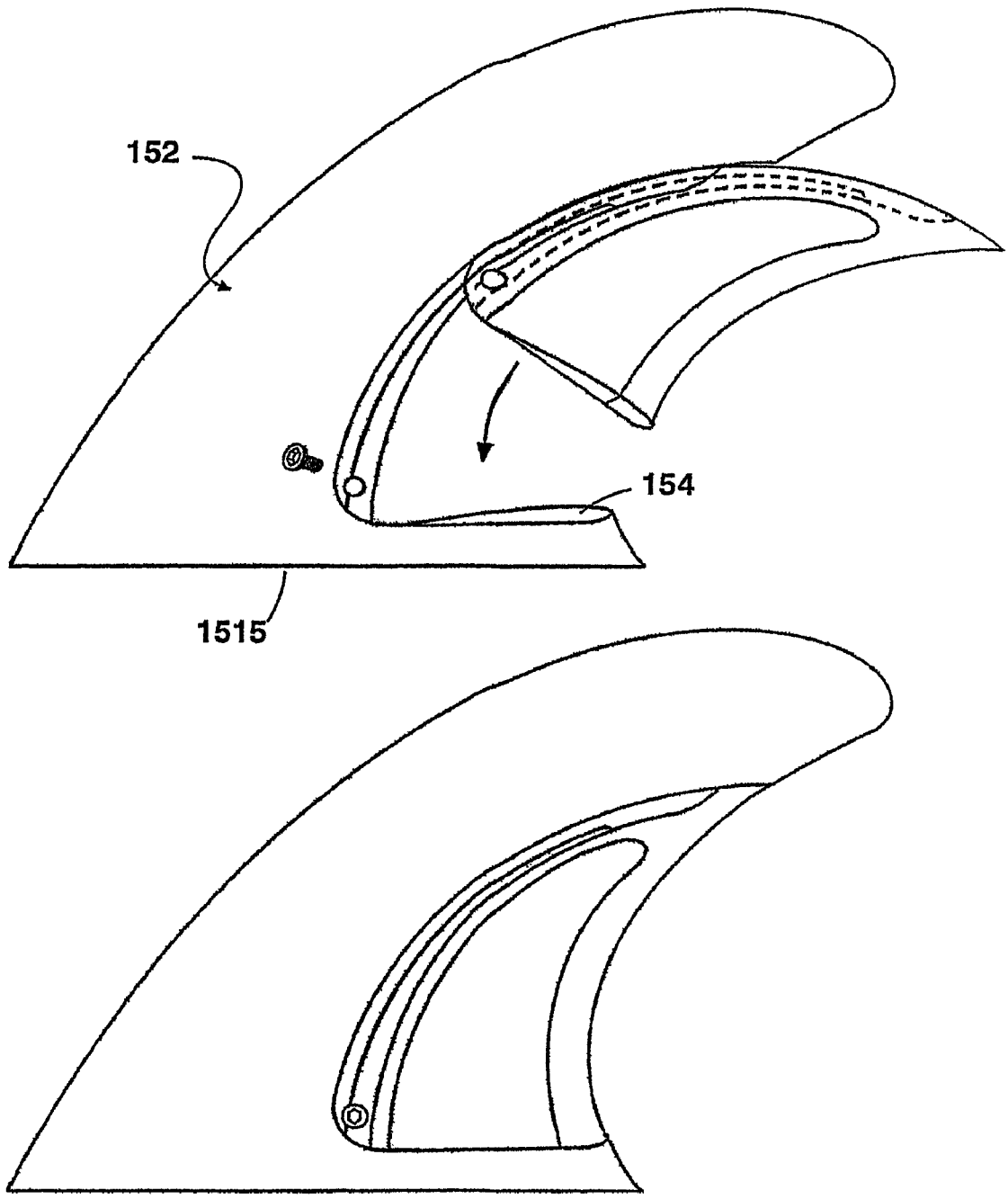
FIG. 15 illustrates an isometric view of a similar embodiment to that illustrated in FIG. 2 except that the stop member in this particular embodiment is an integral part of the major portion and the peg is missing.

FIG. 15 shows an isometric view of a similar embodiment to that illustrated in FIG. 2 except that the stop member (154) in this particular embodiment is an integral part of the major portion (152) and the peg (10) of FIG. 2 is missing in this particular embodiment allowing the base (1515) to be fixed in the traditional manner to a surf board (not illustrated).

Figure 16:
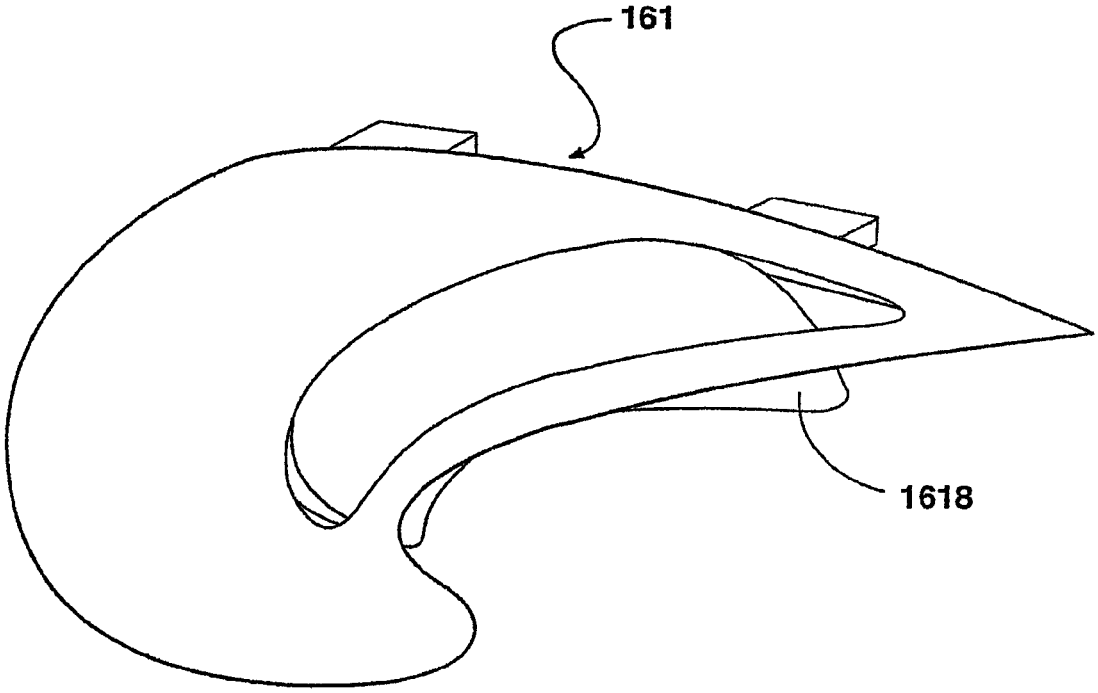
FIG. 16 illustrates an isometric view of another embodiment of a lateral fin where a trailing edge of a first portion of the fin does not form part of the trailing edge of the assembled fin.

FIG. 16 shows an isometric view of another embodiment of a lateral fin generally referenced (161) where a trailing edge of the minor portion (1618) of the fin (161) does not form part of the trailing edge of the assembled fin (161). In essence, the minor portion (1618) is housed within an aperture of the fin (161).

Figure 17:
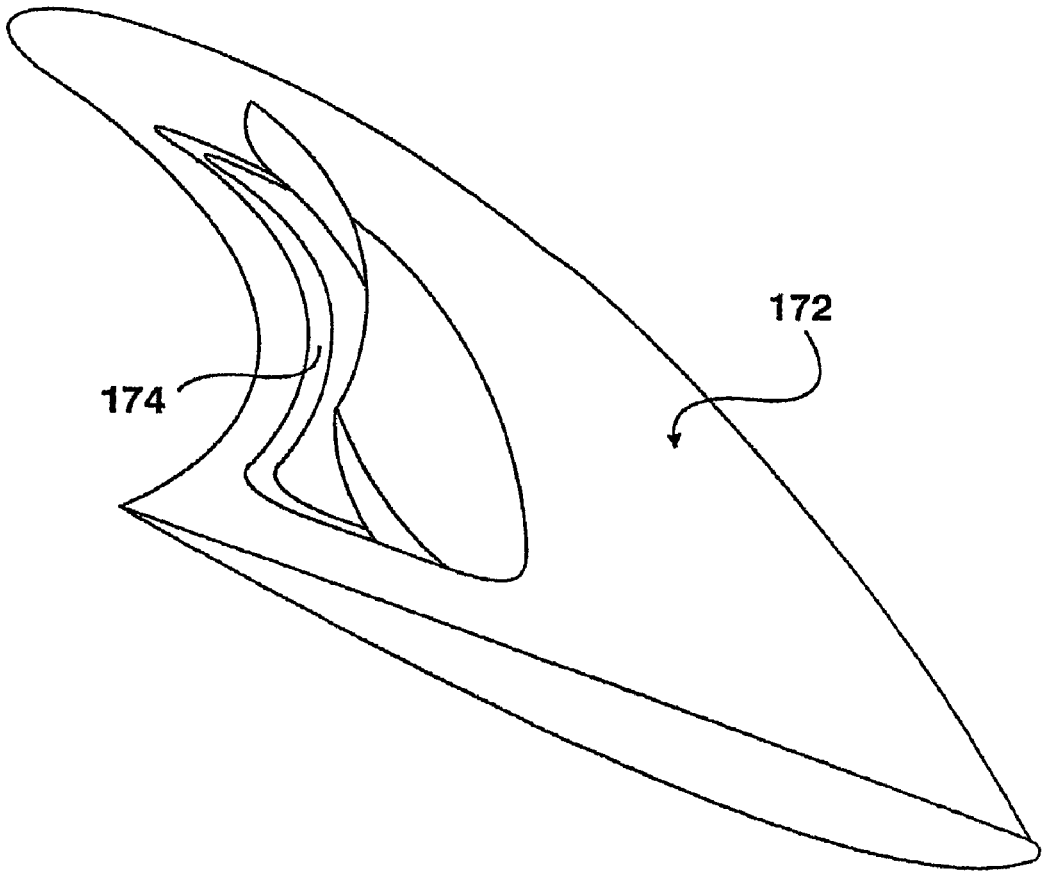
FIG. 17 illustrates a variant of the embodiment illustrated in FIG. 16.

FIG. 17 shows an alternative embodiment to that shown in FIG. 16 essentially from the other side, highlighting the single stop member (174) that runs continuously and substantially uniformally along three sides of the major portion (172).

Figure 18:
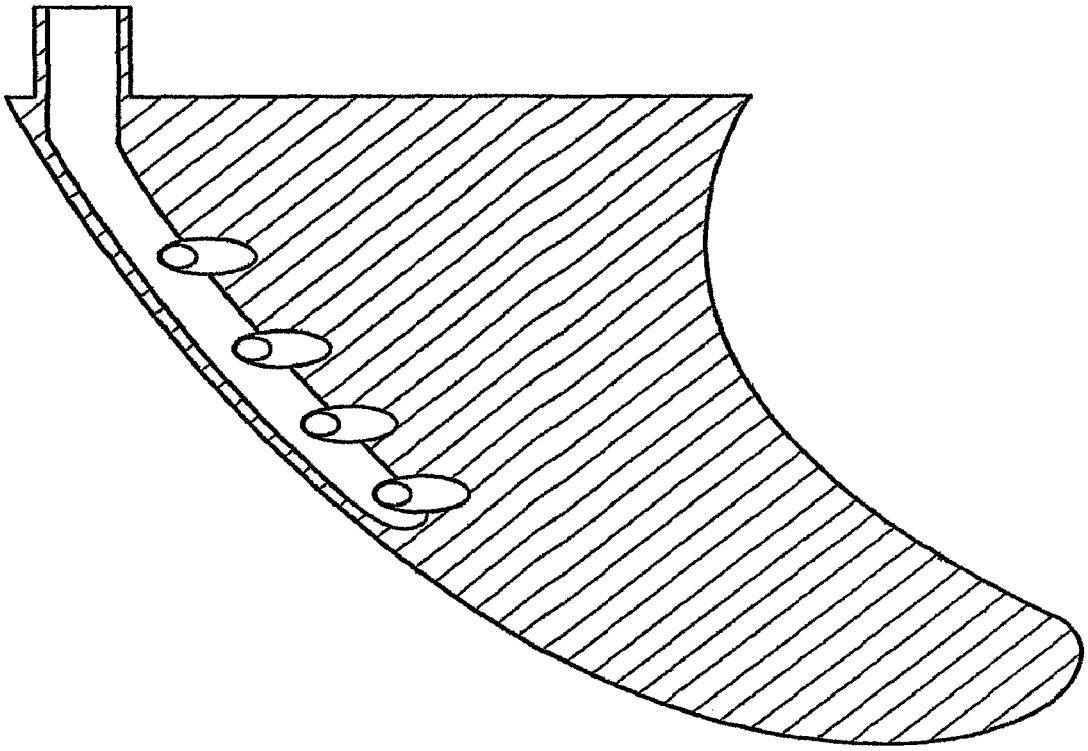
FIG. 18 illustrates in cross section, yet another embodiment of a lateral fin of the present invention.

FIG. 18 shows in cross section a variant of the embodiment shown in FIG. 7. The fin is a single fin with no major or minor portion but possesses the ducting and air holes that the inventor believes also tend to reduce the turbulence associated with high speed turns, thus tending to prevent the phenomenon of known as spin out.

Figure 19:
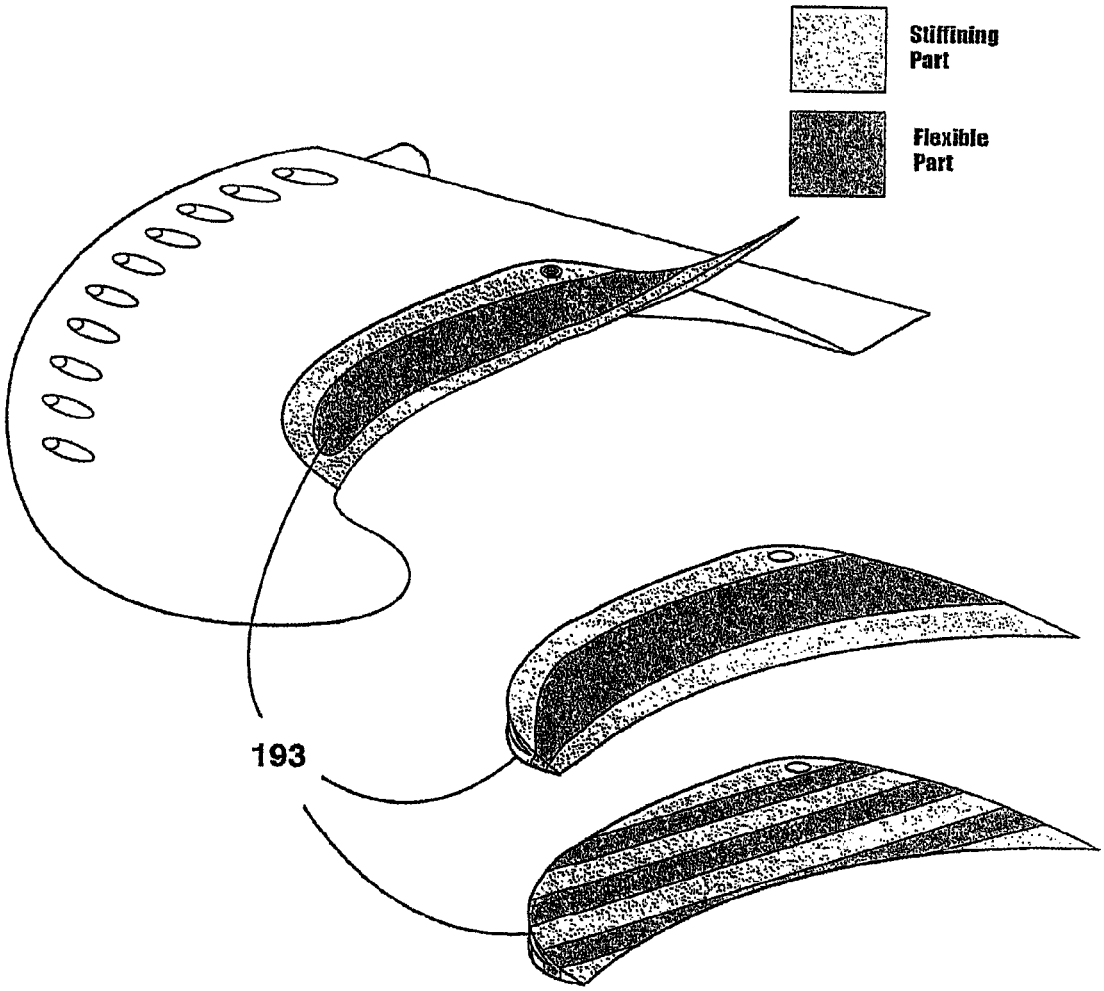
FIG. 19 illustrates an isometric view of a flexing embodiment, similar to the embodiment of FIG. 10 but also showing different types of minor fin portion highlighted by differing colour tones to illustrate differing arrangements of types of plastics materials used to make up a first portion.

FIG. 19 shows an isometric view of a flexing embodiment (with the minor portion (193) flexing at its unsecured end), similar to the embodiment of FIG. 10 but also showing different types of minor portion (193) highlighted by differing colour tones to illustrate differing integral arrangements of types of flexible and relatively non flexible plastics materials used to make up the minor portion (193).

Figure 20:
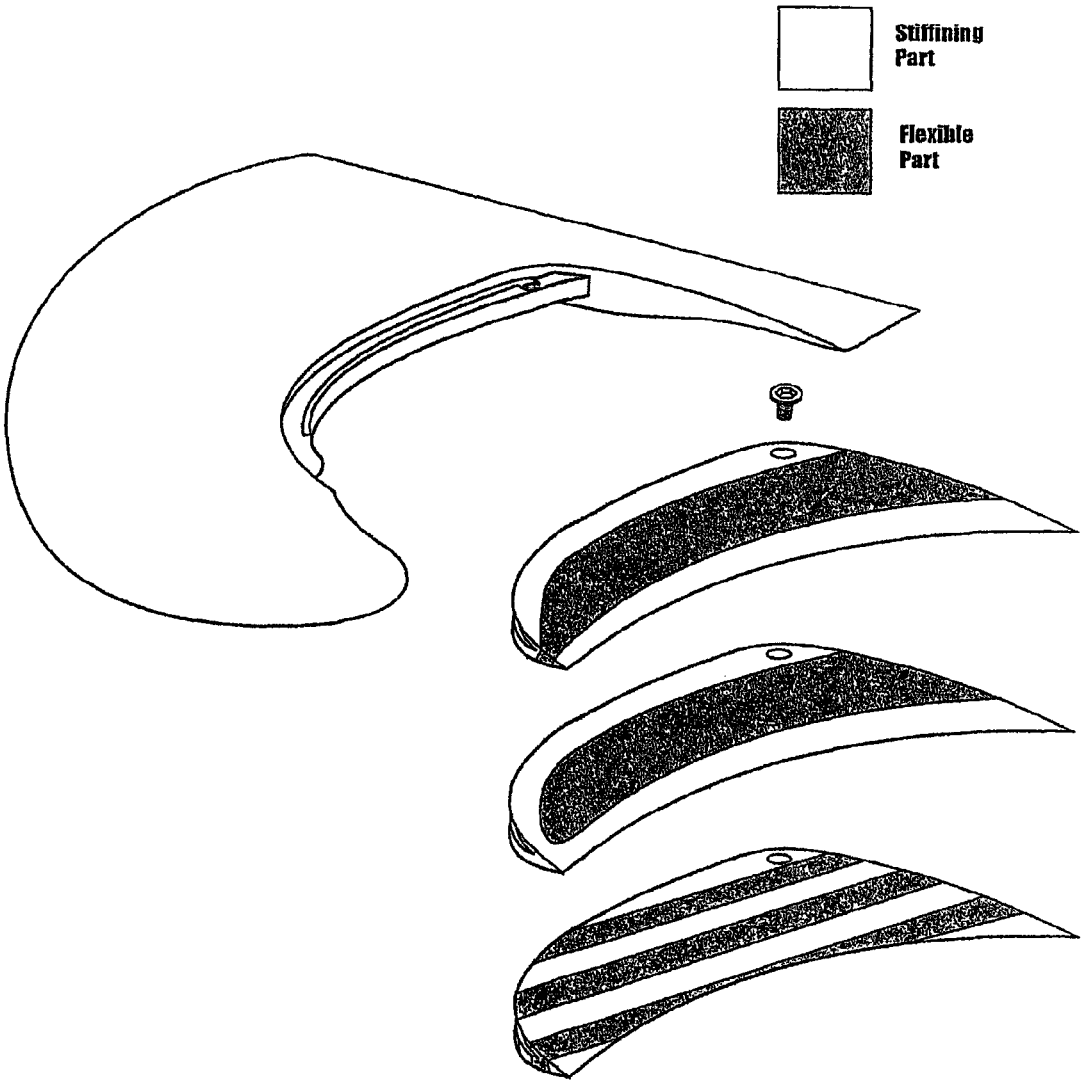
FIG. 20 illustrates in isometric exploded view, an embodiment of a lateral fin similar to that shown in FIG. 4 but encompassing different types of first portion somewhat akin to those illustrated in FIG. 19.

FIG. 20 shows in isometric exploded view, an embodiment of a lateral fin similar to that shown in FIG. 4 but encompassing different types of minor portion somewhat akin to those illustrated in FIG. 19.

Figure 21:
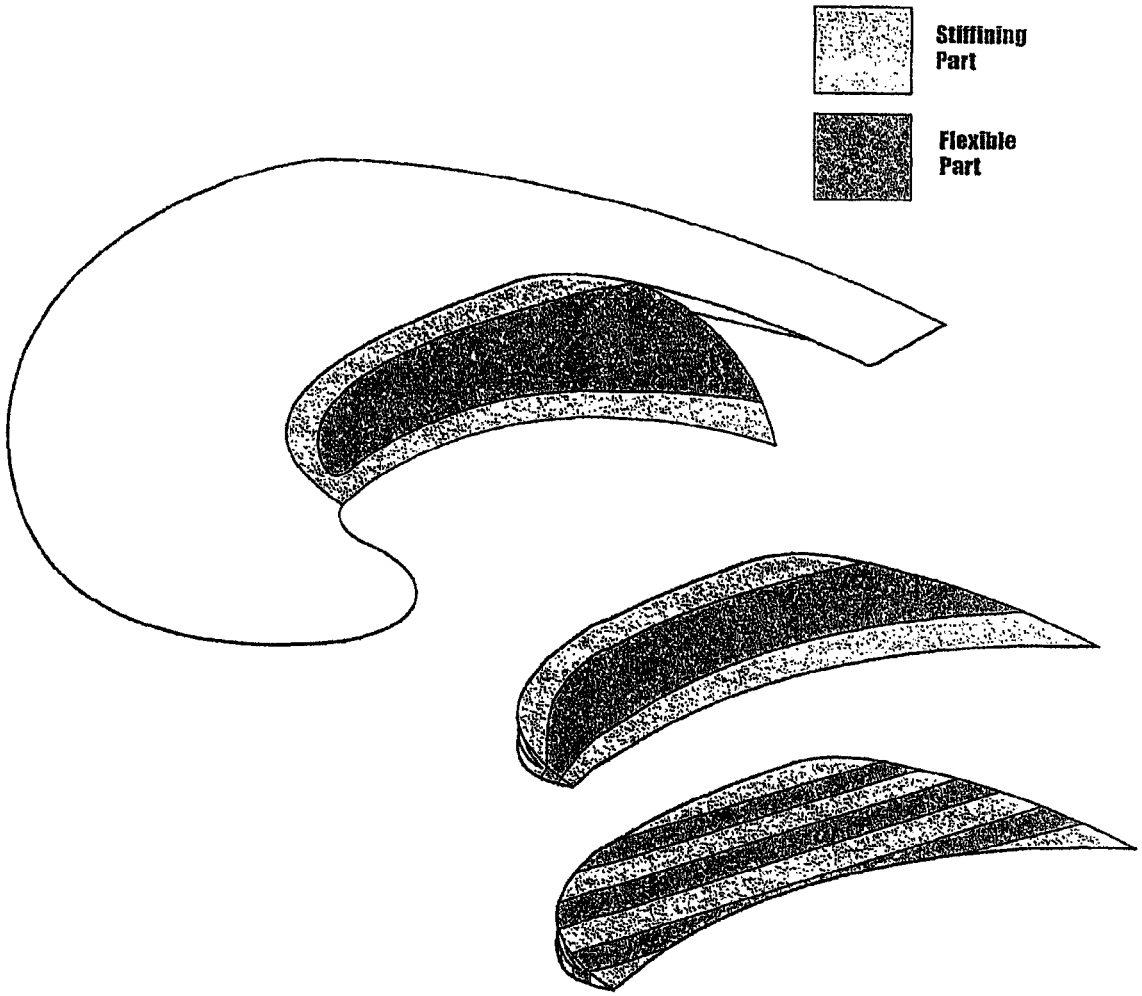
FIG. 21 illustrates a variant of the lateral fin illustrated in FIG. 20, fully assembled with one of the first portions glued into place and flexing.

FIG. 21 shows a variant of the lateral fin illustrated in FIG. 20, fully assembled with one of the minor portions glued into place and flexing, together with other types of minor portion comprising different types of plastics material of the type described herein.

Figure 22:
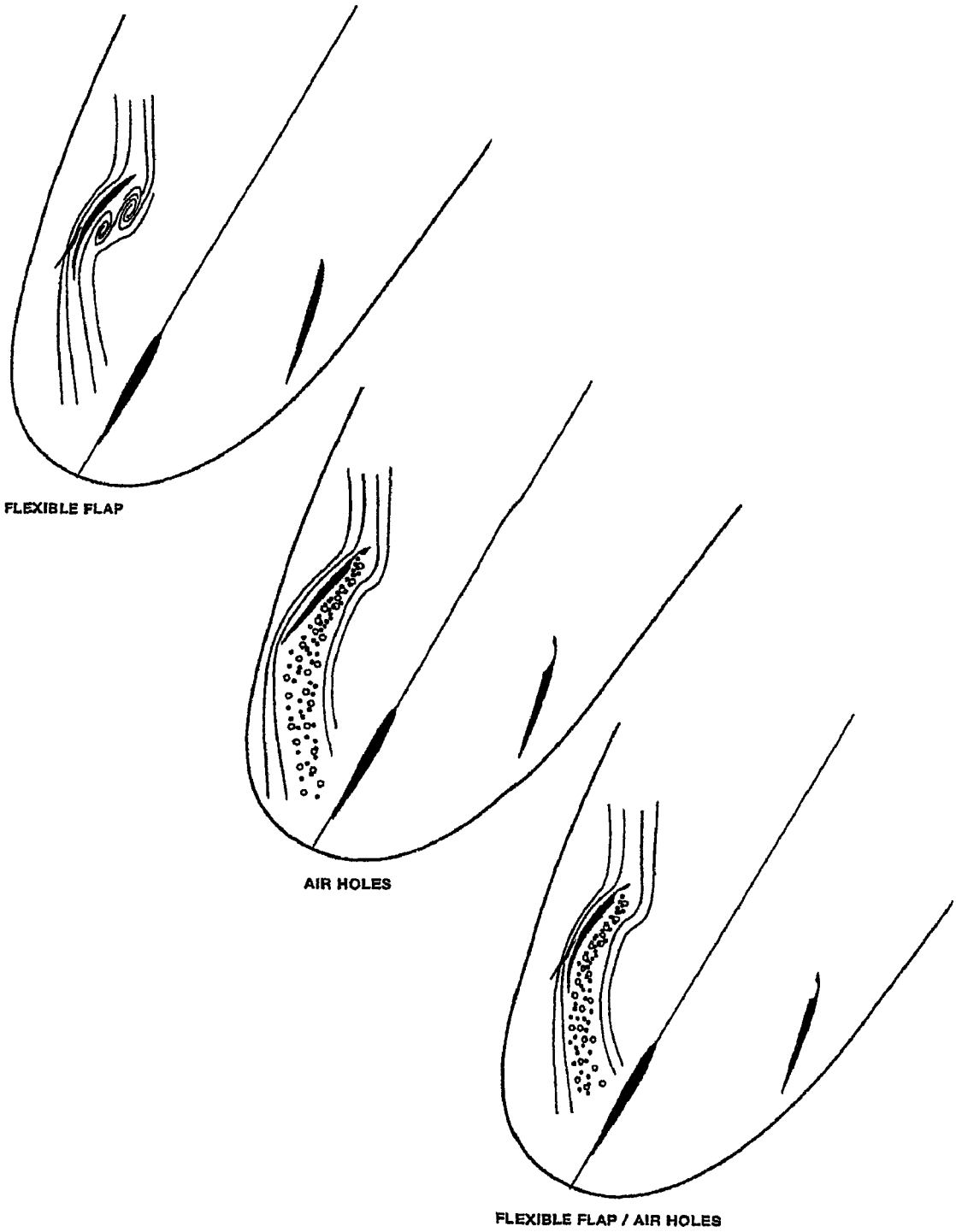
FIG. 22 illustrates stylised water flow across three types of one of the lateral fins of the present invention when it is attached to a surfboard.

FIG. 22 shows an underside view of three surfboards showing their fin arrangement and a stylised view of water flow about one of the lateral fins. Each board show the expected water flow with three different embodiment types, the first (uppermost) shows a flexible minor portion moving, the second (middle) shows a non flexible air hole variant and the third (lowermost) shows a combined air hole/minor portion moving variant.

Each demonstrates a lower degree of turbulence and an attempted re-establishment of the Coanda effect.

Figure 23:
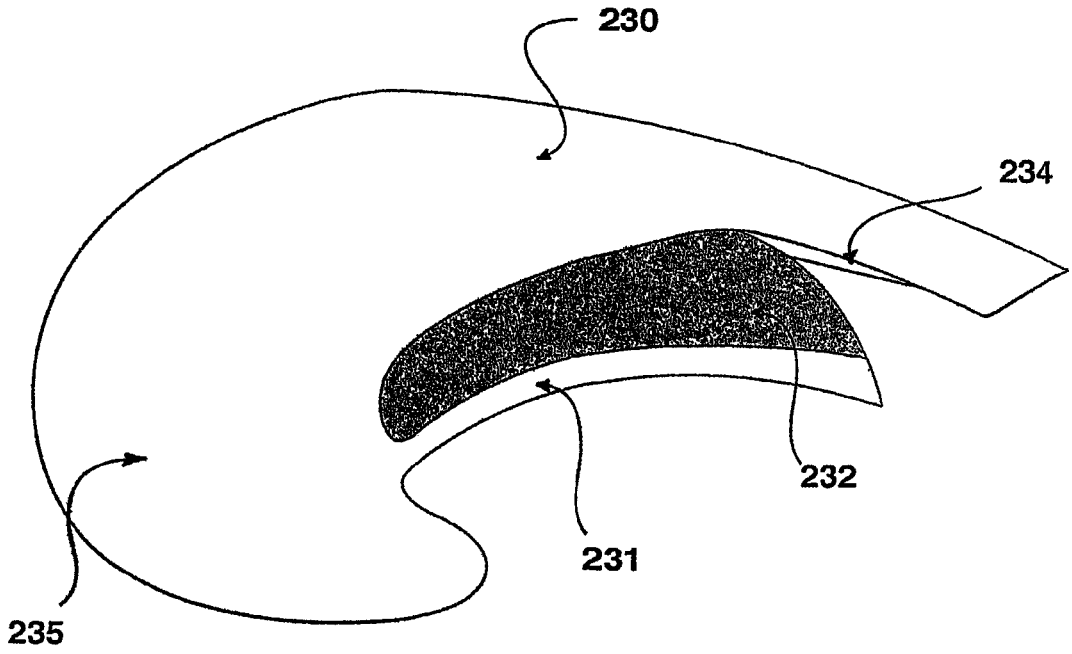
FIG. 23 illustrates an isometric view of another variant of an integral lateral fin.

FIG. 23 shows an integral lateral fin generally referenced (230) formed from two types of plastics polymer, the relatively hard polypropylene and a relatively soft silicone co-polymer. Whilst some of the FIGS. e.g. 2, 3, 4, 5 & 11 are integrally assembled, some others e.g. 6, 23 & 24 are integrally formed.

In this particular embodiment, the first portion formed from the silicone co-polymer (the one that is designed to flex) (232) is integral with the rest of (or the second portion (235)) of the fin (230) in a substantially continuous substantially curved "V" shaped manner along both the leading and trailing edges of the first portion (232). The base of the "V" forms the apex of the first portion (232), the first portion to all intents and purposes being housed within the confines of the arms and base of the "V".

This arrangement provides the first portion (232) with some structural rigidity as the trailing edge of the fin (230) is formed from the polypropylene polymer and the leading edge of this trailing edge is integral with the trailing edge of the first portion (232). The trailing edge of the fin (230) slightly and gradually increases its dimensions as one moves from the base of the "V" along the trailing edge arm of the "V" towards the stop member (234) and the base of the first portion (232).

The base of the first portion (232) together with that portion of the trailing edge of the fin (230) that is flush with the base of the first portion (232) are both free to flex relative to the rest of the fin (230) in one direction only thanks to the stop member (234).

In use, it will be appreciated that that the degree of flexing available to the first portion (232) will become greater as one moves from the apex of the first portion (232) {in other words the base of the "V"} and towards the stop member (234). Furthermore, as only the base of the first portion (232) is completely free to move relative to the rest of the fin (230), it will be appreciated that the degree of flex available at the apex of the first portion (232) is not going to be the same as other embodiments where both the base and apex of theses equivalent portions are both completely free to flex.

Figure 24:
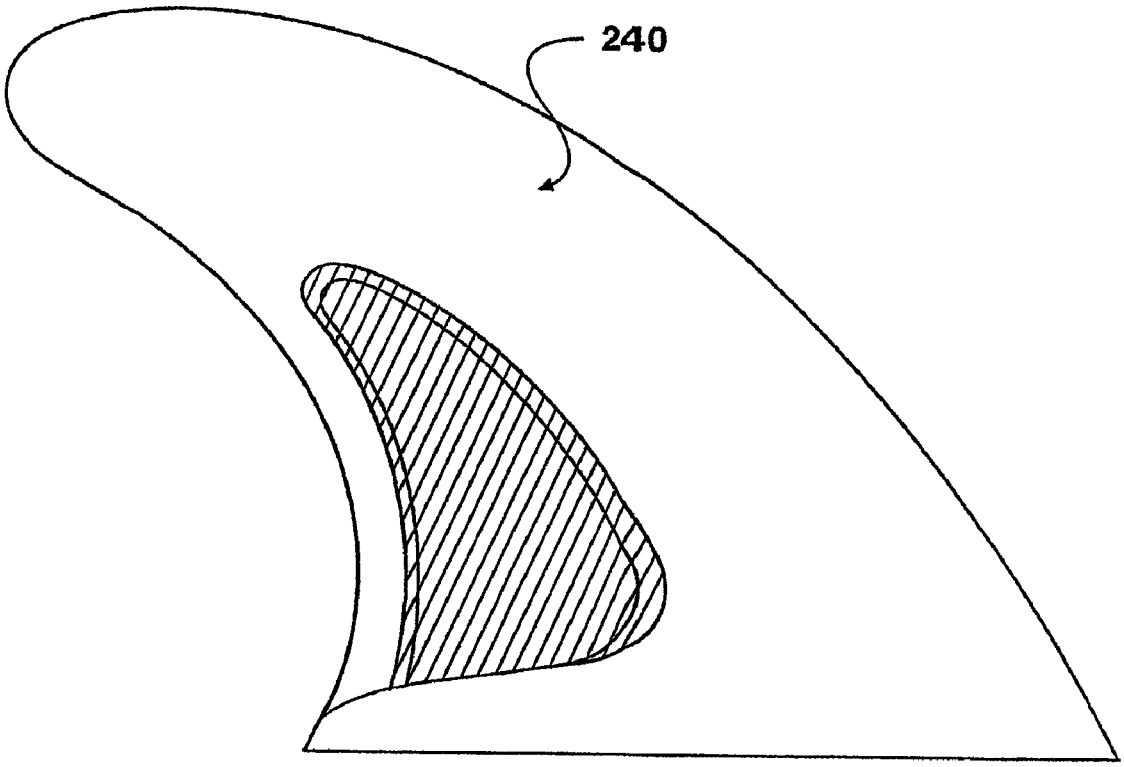
FIG. 24 illustrates a front view of a variant similar to the one illustrated in FIG. 23.

Turning now to the embodiment shown in FIG. 24 that is generally referenced (240), this is similar to the fin (230), however the overall shape of the fin in this particular embodiment is slightly different.

It is to be appreciated that in all of the embodiments herein described, a lateral fin is shown, the majority with a minor and major portion, for the avoidance of doubt and to all intents and purposes the invention is also intended to include within its scope the minor portion of any one embodiment (with the appropriate redesign) being fitted to a major portion of any other embodiment. It is to be appreciated that the invention could be applied to a keel fin or centre or dagger board.

Throughout the description and claims of this specification the word "comprise" and variations of that word, such as "comprises" and "comprising", are not intended to exclude other additives, compartments, integers or steps. Furthermore, throughout this specification, the use of the word "integral" is intended to cover not only something which is formed from the outset as one single-entity component, but also anything which whilst being assembled from a plurality of initially disparately produced integers, ends up as one overall and normally non-dismantleable structure.

This invention may broadly be said to consist in the parts, elements and features referred to or indicated in the specification of the application, individually or collectively, and any or all combinations of any two or more of the parts, elements or features, and where specific integers are mentioned herein, which have known equivalents, such equivalents are deemed to be incorporated herein as individually set forth.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

The invention claimed is:

1. A sailboard or surfboard lateral fin comprising:

a first portion;

a second portion to which the first portion is operative linked, the second portion having opposing first and second faces; and a stop member;

wherein the first and second portions are arranged such that the first portion is adapted to move relative to the second portion within a zone disposed along the first face of the second portion, the stop member being positioned to prevent movement of the first portion within a zone disposed along the second face of the second portion;

wherein a leading edge of the first portion remains aligned with the second portion as the first portion moves relative to the second portion; and wherein the lateral fin is free of any component that is capable of moving into the zone disposed along the second face of the second portion.

2. A fin as claimed in claim 1, wherein the first portion is a minor portion and the second portion is a major portion of the fin.

3. A fin as claimed in claim 2, wherein movement of the first portion is in the form of a progressive flexing curl substantially about the leading edge of the first portion.

4. A fin as claimed in claim 1, wherein the stop member forms part of the second portion, so that the first portion can be locked relative to the second portion.

5. A fin as claimed in claim 1, comprising two said stop members, each one acting on a different part of the first portion of the fin.

6. A fin as claimed in claim 1, wherein the first and second portions are provided with complementary engaging members to enable the portions to be operatively linked.

7. A fin as claimed in claim 6, wherein one of the complementary engaging members is provided with a guide member.

8. A fin as claimed in claim 7, wherein the guide member is located on the engaging member carried by the second portion.

9. A fin as claimed in claim 1, wherein the fin is provided with complementary male and female locking members to lock the first portion to the second portion.

10. A fin as claimed in claim 1, wherein the first portion comprises first and second plastic materials, the first plastic material having a hardness different from a hardness of the second plastic material.

11. A fin as claimed in claim 1, wherein upper and lower edges of the first portion lie between upper and lower edges of the second portion once both portions are operatively linked to form the fin.

12. A fin as claimed in claim 1, wherein the first portion forms part of a trailing edge of the fin.

13. A fin as claimed in claim 1, comprising a plurality of said first portions.

14. A fin as claimed in claim 12, wherein at least one portion of the trailing edge of the fin moves when the first portion moves.

15. A fin as claimed in claim 1, wherein the first and second portions are arranged so that a trailing edge of the second portion moves when the first portion moves.

16. A fin as claimed in claim 1, wherein the fin is also provided with apertured ducting to enable a fluid to enter the ducting and exit through one or more of the apertures and over a portion of one side of the fin.

17. A fin as claimed in claim 16, wherein the fluid is air.

18. A surfboard or sailboard incorporating a fin as claimed in claim 1.

* * * * *